United States Patent [19]

Kelly

[11] 4,199,176

[45] Apr. 22, 1980

[54] DEAD BOLT CABLE LOCK

[76] Inventor: Joe L. Kelly, P.O. Box 38, Conyers, Ga. 30207

[21] Appl. No.: 912,195

[22] Filed: Jun. 5, 1978

[51] Int. Cl.[2] ..... F02N 11/00

[52] U.S. Cl. ..... 292/38; 292/50; 292/141

[58] Field of Search ..... 292/84, 28, 50, 125, 292/141, 341.13, 38; 109/61

[56] References Cited

U.S. PATENT DOCUMENTS

| | | | |
|---|---|---|---|
| 144,288 | 11/1873 | Rand | 292/38 |
| 344,174 | 6/1886 | Driscoll | 292/141 |
| 1,136,254 | 4/1915 | Mosler et al. | 292/38 X |
| 1,180,123 | 4/1916 | Florcken | 292/141 X |
| 1,700,557 | 1/1929 | Cherniack et al. | 292/50 |
| 1,866,684 | 7/1932 | Leun | 292/50 X |
| 2,507,328 | 5/1950 | Ashley | 292/141 X |
| 2,541,352 | 2/1951 | Ginter | 292/50 X |
| 3,584,905 | 6/1971 | Emenaker | 292/38 |

FOREIGN PATENT DOCUMENTS

| | | | |
|---|---|---|---|
| 17188 | of 1908 | United Kingdom | 292/141 |

*Primary Examiner*—J. Franklin Foss

*Attorney, Agent, or Firm*—Newton, Hopkins & Ormsby

[57] ABSTRACT

An uninterrupted cable directly carries a plurality of dead bolts which are simultaneously moved by the cable toward and away from active locking positions. Movement of the cable on cable support and guiding elements is under control of a handle or power actuator and the system may include a cable slack takeup device, a force multiplier, or a device to increase the length of travel of bolts attached to the cable.

10 Claims, 8 Drawing Figures

DEAD BOLT CABLE LOCK

BACKGROUND OF THE INVENTION

Dead bolt arrangements and bolts having cable operators are both known, broadly speaking, in the prior art. To comply with the duty to disclose known prior art under 37 C.F.R. 1.56, the following prior United States patent Nos. are made of record herein:

144,288; 913,269; 2,066,705; 2,879,725; 3,584,905.

The objective of the present invention is to significantly improve on the prior art, both in terms of structural simplicity and manufacturing practicality in a dead bolt cable lock capable of wide utility and affording maximum security in connection with various types of closures. Particularly, the invention entirely eliminates the need for intermediate links, levers and the like which are employed in the prior art to connect the cable operator to a bolt or bolts of a locking system. In the present invention, the several bolts are directly secured to a guided cable loop and are simultaneously shifted to and from active locking positions on a closure without lost motion and without the cost and complication of intermediate mechanisms.

Variants of the invention allow movement of the cable and bolts by simple rotation of a handle or through a handle driven mechanism which provides a mechanical advantage, or a system which increases bolt linear travel.

Other features and advantages of the invention will become apparent during the course of the following description.

DETAILED DESCRIPTION

Figure 1:
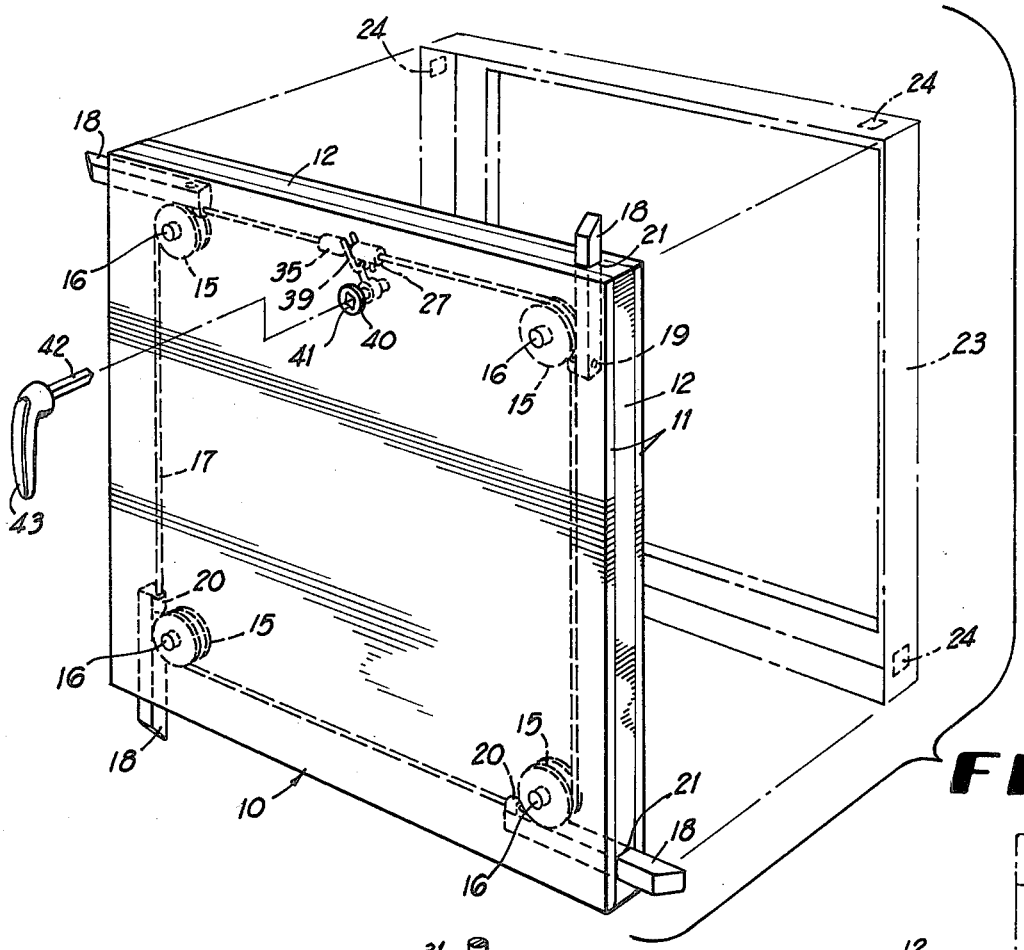
FIG. 1 is a perspective view of a dead bolt cable lock in accordance with one preferred embodiment of the invention.
Figure 2:
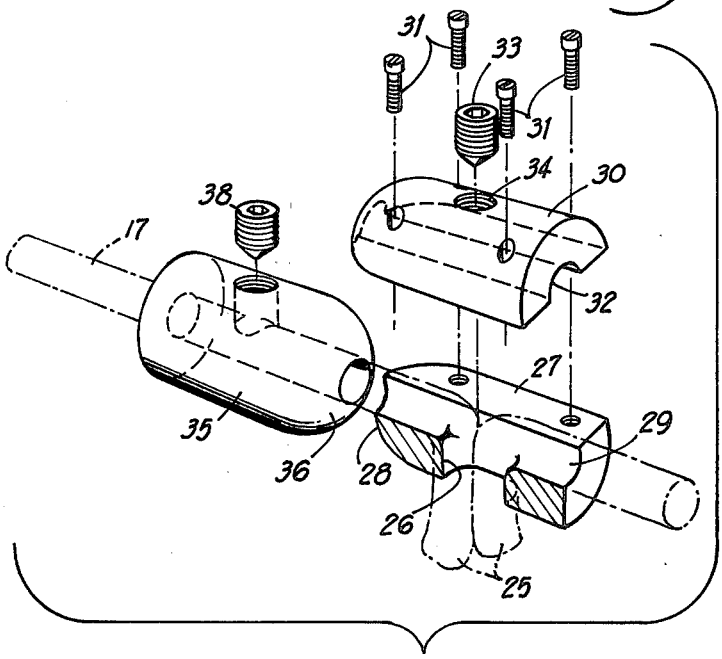
FIG. 2 is a fragmentary exploded perspective view, partly in section, of a cable end connector and drive means.
Figure 3:
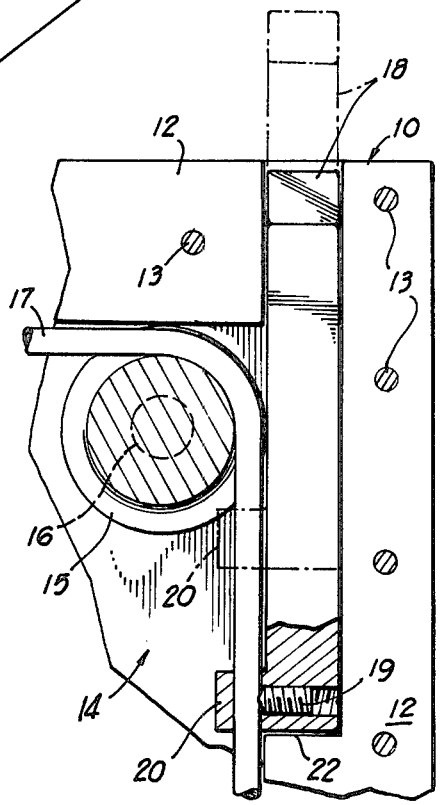
FIG. 3 is an enlarged fragmentary vertical section taken through one corner portion of the locking system on an enlarged scale and showing one cable attached bolt.

Referring initially in detail to FIGS. 1 through 3 of the drawings, wherein like numerals designate like parts, a hatch or door 10 of rectangular formation includes spaced parallel panels 11 and marginal spacer bars 12 between the panels and secured thereto rigidly as by spaced fasteners 13 shown in FIG. 3. In the interior chamber 14 of the door or hatch 10 defined by the panels 11 and spacer bars 12 and near the four corners of the assembly are cable guide pulleys 15 whose support axles 16 are suitably anchored to the two panels 11 with the pulleys disposed therebetween for free rotation. A continuous cable loop 17 is trained over the pulleys 15 to establish four right angular straight cable stretches or runs each of which has a single dead bolt 18 fixed thereto directly by means of a set screw 19 bearing upon the cable 17 within an apertured inner side lug 20 of the bolt 18, FIG. 3. Each corner bolt 18 is parallel to the particular stretch of cable to which it is attached and each bolt projects through a corner rectangular cross section passage 21 formed by the end face of one bar 12 and a recess 22 of the adjacent right angular bar. Each bolt 18 is positively guided on a linear path of movement with the cable stretch to which it is attached by the opening 21 and by the periphery of the adjacent pulley 15 in conjunction with the outer side of the recess 22, FIG. 3.

It may be seen that movement of the cable loop in one direction over the pulleys 15 will simultaneously thrust the dead bolts 18 outwardly of the margins of the hatch or door 10 to locking positions, and movement of the cable loop in the opposite direction will retract the four bolts simultaneously fully inside of the door or hatch as depicted in full lines in FIG. 3. The door or hatch 10 may be locked with a frame 23 or the like, FIG. 1, having corner openings 24 constituting dead bolt keepers.

The ends 25 of cable loop 17, FIG. 2, are firmly secured in a side aperture 26 of an end connector or terminal 27 having a spherically rounded end 28 and a longitudinal bore 29 at right angles to the aperture 26, and through which the cable extends. A clamping cap 30 for the terminal 27 is secured by screws 31, the cap having a longitudinal recess 32 engaged over the portions of the cable lying in the bore or recess 29. The cable ends 25 are further locked by a cone pointed set screw 33 received by a threaded opening 34 in the cap 30 and bearing on the two cable ends as they pass into the aperture 26.

A coacting lug or fitting 35 having a spherically rounded end 36 in spaced opposed relationship to the rounded end 28 has a through bore 37 receiving the cable 17. A cone pointed set screw 38 locks the lug or fitting 35 fixedly to the cable in spaced relationship to the terminal 27 and its cap 30. These two elements 35 and 27, FIG. 1, form an actuating means for the cable loop 17 in conjunction with a forked actuating lever 39 whose forked end is trapped between the elements 35 and 27 in sliding engagement with the spherically rounded ends 28 and 36. The forked operating lever 39 has its hub attached to a rotational shaft 40 on the hatch or door 10, such shaft having a square drive socket 41 for receiving a square shank 42 of a turnable operating handle 43 on the exterior of the door or hatch 10 midway between two of the pulleys 15. Manual rotation of the handle 43 in one direction will move the cable loop 17 to extend the dead bolts 18, and rotation of the handle 43 in the other direction will effect retraction of the dead bolts into the door or hatch 10.

The locking system is simple, direct acting with no lost motion, positive and secure. No levers, cranks, gears or links are utilized between the driving cable and the dead bolts 18 which are directly secured to the cable to move on right angular paths with the four sides or stretches of the cable loop.

Figure 4:
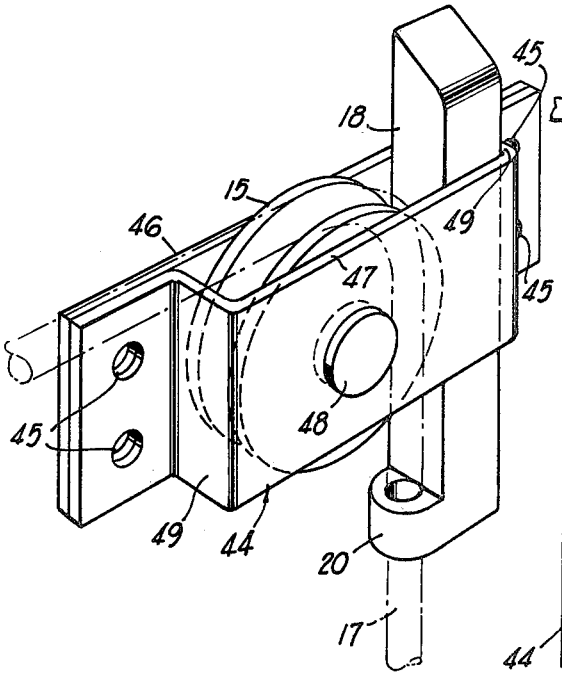
FIG. 4 is a perspective view showing a support and guide bracket for a bolt and adjacent cable pulley in accordance with a modification.

FIG. 4 shows a variant of the support and guiding means for each cable pulley 15 and dead bolt 18 of the multi-bolt system. In lieu of the corner openings 21 and spacer bar recesses 22 of FIG. 3, a metal support bracket 44 is utilized having opposite end apertures 45 in its two sections or plates enabling the bracket to be secured by screws to or within a door, hatch or other closure. The two spaced parallel plates 46 and 47 of bracket 44 support the axle 48 of the pulley 15 and the two plates 46 and 47, the periphery of the pulley 15 and one of the end walls 49 of plate 47 form a positive guide for the linear movement of the bolt 18 through the bracket in response to the movement of the cable loop 17 in the manner disclosed in connection with FIGS. 1 to 3.

Figure 5:
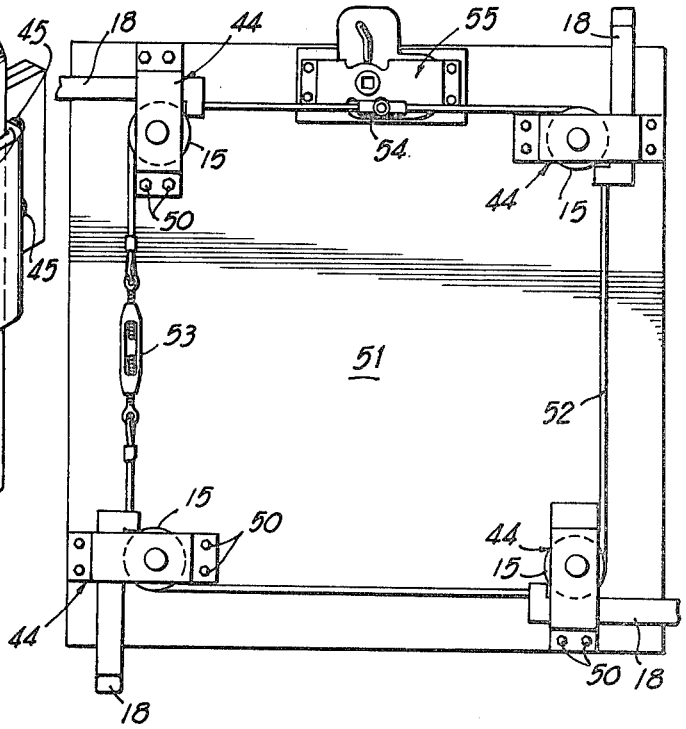
FIG. 5 is an elevational view of a multi-bolt locking system employing the bracket structure of FIG. 4.

FIG. 5 shows a four bolt locking system utilizing four of the mounting brackets 44 shown in FIG. 4, which mounting brackets are fixedly secured by fasteners 50 to a panel 51, container lid or the like. Four dead bolts 18, in accordance with FIG. 4, are shown in FIG. 5 and these bolts are secured by the means shown in FIG. 3 to a cable loop 52 similar to the loop 17. The cable loop 52 is equipped with a turnbuckle 53 to take up any slack which may exist in the cable.

In lieu of the cable driving means 35, 27, 40, etc. shown in FIG. 1, the cable loop 52 is attached by a movable anchor 54 to a three point lock assembly 55 on the panel 51 near one edge thereof and between two of the brackets 44. Such a lock is conventional and its operation to move the cable loop 52 for extending or retracting the bolts 18 need not be described in full detail. The lock 55 is manufactured and sold by A. L. Hansen Mfg. Co., 2155 Delaney Road, Gurnee, Ill. 60031. Through use of the three point lock 55, the anchor 54 is movable in opposite directions to move the cable loop 52 and extend or retract the dead bolts 18 substantially as described in connection with FIGS. 1 to 3. While an overcenter lock has been delineated herein, a slam mechanism could be substitued and would accomplish the same effect.

Figure 6:
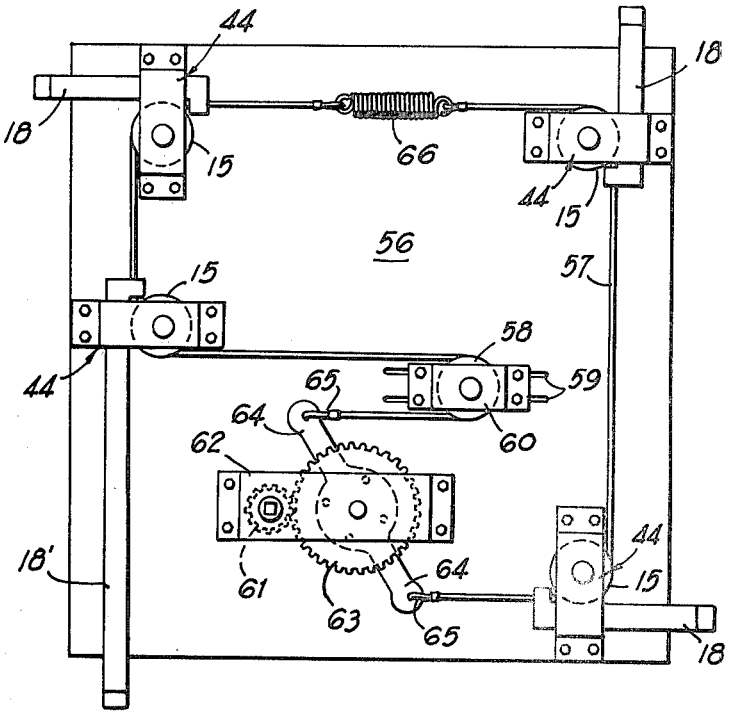
FIG. 6 is an elevational view, similar to FIG. 5, showing a modified system containing a force multiplier and cable slack take-up means.

FIG. 6 shows a further modification of the invention wherein a panel or closure 56 has mounting brackets 44 and associated pulleys 15 attached thereto in the relationship illustrated. Three of the dead bolts 18 near three corners of the panel 56 are shown and the fourth dead bolt 18' of the four bolt system is of a longer length in view of the placement of its associated bracket 44, FIG. 6.

In lieu of a turnbuckle in the cable loop 57 to which the bolts 18 and 18' are attached, a slidably adjustable idler pulley 58 is utilized at the center portion of the panel 56 which has a pair of adjusting slots 59 for the bracket 60 used to mount the idler pulley 58.

The dead bolt cable lock system of FIG. 6 includes means to provide a mechanical advantage from the operating handle, not shown, on the far side of the panel 56 similar to the handle 43. Such operating handle drives or turns a small gear 61 journaled on a mounting bracket 62 and meshing with a larger gear 63 on such bracket to which crank arms 64 are attached; these arms are directly connected to a pair of cable loop terminals 65, as shown. When the arms 64 rotate, the cable ends shown parallel in FIG. 6 become more distantly spaced causing stretching of the cable loop 57. To compensate for this stretching, a retractile spring 66 is connected in the cable loop. This spring produces another desirable effect since it biases to some extent the locking and release positions of the bolt 18.

Figure 7:
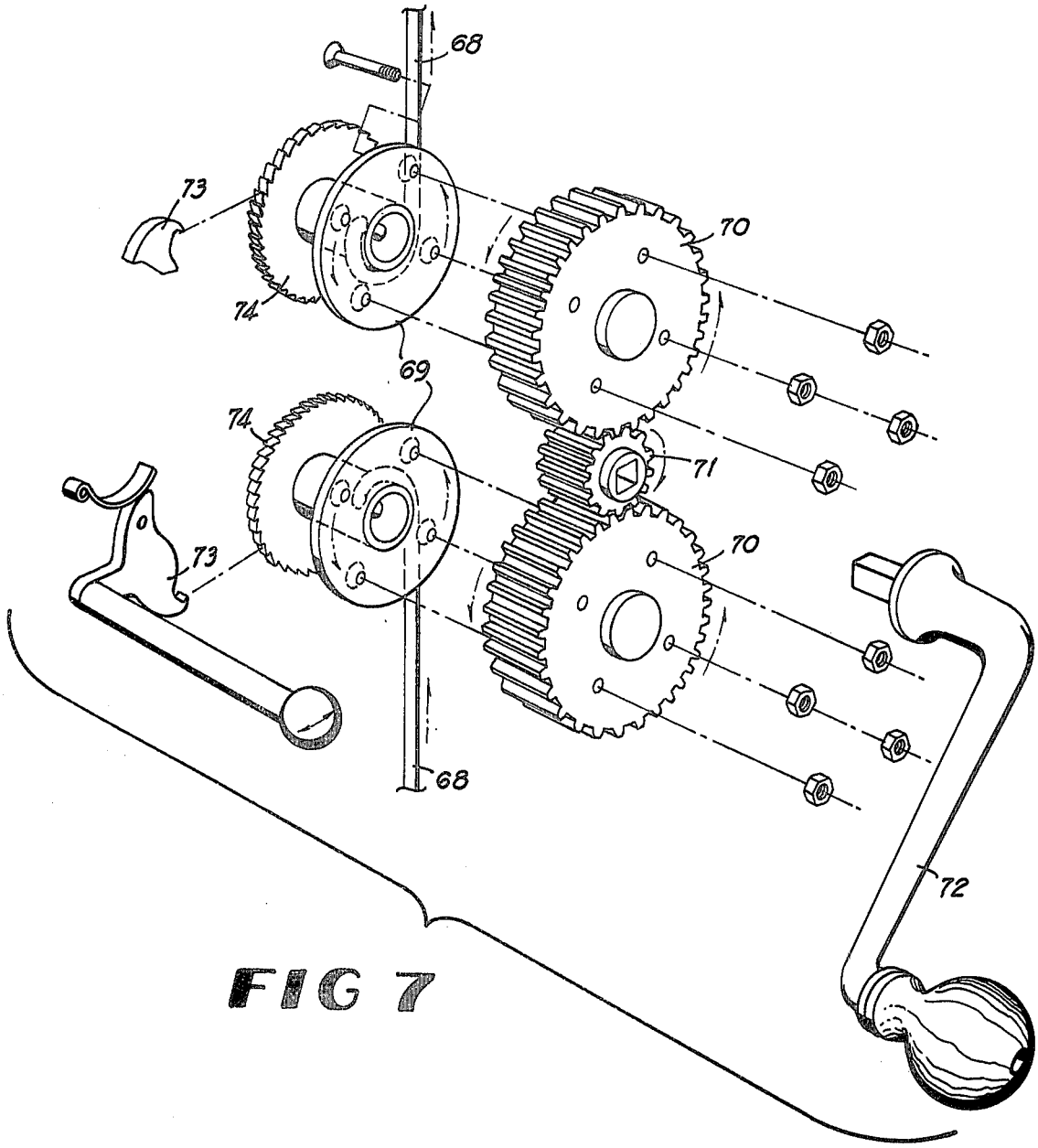
FIG. 7 is an exploded perspective view of means to increase bolt stroke in a locking system according to a further modification of the invention.
Figure 8:
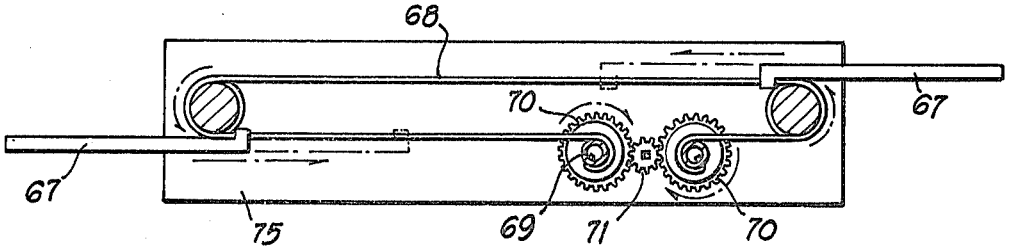
FIG. 8 is a sectional view of a locking system employing the means shown in FIG. 7.

FIGS. 7 and 8 show a further modification of the invention in which the dead bolts 67 attached to cable loop 68 require a greater length of travel than in the prior embodiments. To satisfy this requirement, a pair of spools 69 is provided to wind a length of cable onto one spool while simultaneously the same length of cable is unwound from the complementary spool 69. The two spools are attached to a pair of spur gears 70 which are driven in opposite directions by a small intermediate driving gear 71 turned by a crank 72. Spring-loaded pawls 73 can engage ratchet discs 74 on the spools 69 to prevent retrograde movement of the two spools. FIG. 8 shows the system of long bolts 67 requiring increased travel and therefore utilizing the mechanism of FIG. 7 in conjunction with a frame or closure 75.

In all embodiments of the invention, the dead bolts are directly fastened to a cable loop to move in unison therewith under influence of a driver and the bolts move on linear paths with the stretches or sides of the cable to which they are attached between locking and release positions. In all embodiments of the invention simplicity of construction, sturdiness and ease of operation are paramount in completely practical dead bolt locking systems without intermediate links or levers being required.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A dead bolt cable locking apparatus comprising a closure element, a cable loop on the closure element, guide and support means for the cable loop on the closure element, a plurality of dead bolts directly attached to the cable loop at spaced points thereon and being movable on linear paths toward and from locking positions with the portions of the cable loop to which the dead bolts are attached, guide means for the dead bolts on the closure element, and drive means for the cable loop on the closure element whereby the cable loop may be moved in opposite directions on said cable loop guide and support means, said cable loop being substantially a rectangular loop having straight stretches, one dead bolt being attached to each stretch of the cable loop in parallel relation thereto and moving in a linear path with such stretch and being disposed at right angles to the next adjacent dead bolts of said apparatus, and said guide and support means for said rectangular loop comprising a pulley at each corner region of the rectangular loop, said drive means for the cable loop comprising a rotary crank element on said closure element having a driving connection with said cable loop between a pair of said pulleys and said driving connection comprising a pair of spaced terminal elements on said cable loop and a forked extension on said crank element engaging between said terminal elements to move them with said cable loop.

2. A dead bolt cable locking apparatus comprising a closure element, a cable loop on the closure element, guide and support means for the cable loop on the closure element, a plurality of dead bolts directly attached to the cable loop at spaced points thereon and being movable on linear paths toward and from locking positions with the portions of the cable loop to which the dead bolts are attached, guide means for the dead bolts on the closure element, and drive means for the cable loop on the closure element whereby the cable loop may be moved in opposite directions on said cable loop guide and support means, said cable loop being substantially a rectangular loop having straight stretches, one dead bolt being attached to each stretch of the cable loop in parallel relation thereto and moving in a linear path with such stretch and being disposed at right angles to the next adjacent dead bolts of said apparatus, and said guide and support means for said rectangular loop comprising a pulley at each corner region of the rectangular loop, said guide means for the dead bolts on the closure element comprising a mounting bracket for each dead bolt and the adjacent pulley, said bracket having a through guide passage for the dead bolt engaging three sides of the dead bolt, a fourth side of the dead bolt being engaged and guided by the adjacent pulley, the dead bolt being rectangular in cross section.

3. A dead bolt cable locking apparatus comprising a substantially rectangular closure element, a substantially rectangular cable loop on the closure element, said loop comprising four straight stretches, each such stretch being parallel and adjacent to a corresponding edge of said closure element, pulleys located adjacent the corners of said closure element, said cable loop passing over said pulleys, dead bolts attached to said cable loop adjacent the corners of the closure element, each such bolt passing over and being partially guided by one of said pulleys and being movable by said cable loop in a path parallel to one edge of said closure element, to and from a locking position in which it extends beyond another edge of said closure element, additional bolt guiding means on said closure element opposite each pulley and drive means for said cable loop on the closure element whereby the cable loop may be moved in opposite directions whereby said bolts are moved to and from locking position.

4. A dead bolt cable locking apparatus as defined in claim 3, and said drive means for the cable loop comprising a rotary crank element on said closure element having a driving connection with said cable loop between a pair of said pulleys.

5. A dead bolt cable locking apparatus as defined in claim 3, and said guide means for the dead bolts on the closure element comprising dead bolt passages opening through the margin of the closure element near each corner thereof.

6. A dead bolt cable locking apparatus as defined in claim 3, and said drive means for the cable loop comprising a lock unit mounted on said closure element and having a movable part, and an anchor element on the cable loop connected with said moving part.

7. A dead bolt cable locking apparatus as defined in claim 6, and a slack take-up means connected in said cable loop.

8. A dead bolt cable locking apparatus as defined in claim 1, and said drive means for the cable loop comprising a rotary driving element, and a force multiplier means driven by said rotary element and connected in said cable loop.

9. A dead bolt cable locking apparatus as defined in claim 3, and said drive means for the cable loop comprising a rotary driving element and gearing connected with said driving element and said cable loop to move said loop a sufficient distance to impart extended travel to said dead bolts connected with and moved by said cable loop.

10. A dead bolt cable locking apparatus as defined in claim 9, and said gearing comprising a comparatively small driving gear, a pair of larger gears meshing with and driven by the small driving gear, and cable winding spools connected with said larger gears and turning therewith whereby one spool winds up cable while the other spool simultaneously pays out the same amount of cable.

* * * * *